US007926737B2

(12) United States Patent
Stoecklein et al.

(10) Patent No.: US 7,926,737 B2
(45) Date of Patent: Apr. 19, 2011

(54) FUEL INJECTOR HAVING DIRECTLY ACTUATABLE INJECTION VALVE ELEMENT

(75) Inventors: Wolfgang Stoecklein, Waiblingen (DE); Thomas Pauer, Freiberg (DE); Christian Kuhnert, Vaihingen/Enz (DE)

(73) Assignee: Robert Bosch GmbH, Stuttgart (DE)

( * ) Notice: Subject to any disclaimer, the term of this patent is extended or adjusted under 35 U.S.C. 154(b) by 420 days.

(21) Appl. No.: 12/096,483

(22) PCT Filed: Oct. 16, 2006

(86) PCT No.: PCT/EP2006/067428

§ 371 (c)(1),
(2), (4) Date: Jun. 6, 2008

(87) PCT Pub. No.: WO2007/068518

PCT Pub. Date: Jun. 21, 2007

(65) Prior Publication Data

US 2008/0302887 A1 Dec. 11, 2008

(30) Foreign Application Priority Data

Dec. 12, 2005 (DE) ..... 10 2005 059 169

(51) Int. Cl.
*F02M 41/16* (2006.01)

(52) U.S. Cl. ..... 239/96; 239/102.2; 239/124; 239/584; 239/600; 123/496; 123/498

(58) Field of Classification Search ..... 239/96, 239/102.1, 102.2, 124, 533.4, 584, 600; 123/496–498

See application file for complete search history.

(56) References Cited

U.S. PATENT DOCUMENTS

| | | | | |
|---|---|---|---|---|
| 6,422,210 | B1 | 7/2002 | Lambert et al. | |
| 6,805,302 | B2 * | 10/2004 | Boecking | 239/102.2 |
| 2002/0014540 | A1 * | 2/2002 | Cooke | 239/584 |
| 2003/0155540 | A1 * | 8/2003 | Stoecklein et al. | 239/102.2 |

FOREIGN PATENT DOCUMENTS

| | | | |
|---|---|---|---|
| DE | 10 2004 005 452 | A1 | 8/2005 |
| EP | 1 079 095 | A2 | 2/2001 |
| EP | 1 621 759 | A1 | 2/2006 |

* cited by examiner

*Primary Examiner* — Steven J Ganey
(74) *Attorney, Agent, or Firm* — Ronald E. Greigg

(57) ABSTRACT

A fuel injector for an internal combustion engine is proposed having a directly actuatable injection valve element. The fuel injector has a nozzle needle, axially guided in a nozzle body, and an actuator accommodated in an injector housing. The nozzle needle is connected to a coupling piston on the nozzle-needle side and the actuator is connected to a coupling piston on the actuator side. The coupling piston on the actuator side acts on a coupling chamber and the coupling piston on the nozzle-needle side acts on a control chamber. The nozzle needle is lifted from a nozzle-needle sealing seat as a function of the pressure in the control space. An intermediate plate is provided between injector housing and nozzle body. The plate has a conduit hydraulically connecting the coupling chamber to the control chamber. The conduit contains a hydraulic throttle which has at least two sections having different cross sections of flow. The section having the smaller cross section of flow faces the coupling chamber and the section having the larger cross section of flow faces the control chamber. The throttle disclosed suppresses oscillations of the actuator in the transmission of the actuator stroke to the nozzle needle stroke.

20 Claims, 2 Drawing Sheets

FUEL INJECTOR HAVING DIRECTLY ACTUATABLE INJECTION VALVE ELEMENT

CROSS-REFERENCE TO RELATED APPLICATION

This application is a 35 USC 371 application of PCT/EP 2006/067428 filed on Oct. 16, 2006.

BACKGROUND OF THE INVENTION

1. Field of the Invention

The invention relates to a fuel injector for internal combustion engines.

2. Description of Prior Art

DE 10 2004 005 452 A1 has disclosed a fuel injector with a directly actuatable injection valve element and a one-stage boosting of the actuator stroke by means of a pulling actuator for opening the nozzle needle. In it, an actuator-side coupler piston actuated by means of an actuator acts on a coupler chamber while a coupler piston connected to the nozzle needle acts on a control chamber. The coupler chamber and control chamber are hydraulically connected via a conduit. The conduit is let into an intermediate disk situated between the injector body and a nozzle body.

Powerful accelerations occur upon actuation of the actuator and corresponding oscillations of the actuator occur at the end of the actuator stroke, both of which are transmitted to the nozzle needle via the hydraulic chambers, causing the nozzle needle to resonate. These oscillations cause fluctuations in injection quantity since changes occur in the throttle cross section of the nozzle needle at the nozzle needle sealing seat.

The object of the present invention is to create a compactly designed fuel injector in which the transmission of the oscillations of the actuator stroke to the nozzle needle is suppressed while nevertheless retaining a rapid opening and closing of the nozzle needle.

SUMMARY AND ADVANTAGES OF THE INVENTION

A fuel injector according to the invention has a hydraulic throttle situated in the conduit between the coupler chamber of the actuator and the control chamber of the nozzle needle. The throttle has at least two sections with different flow cross sections, where the section with the smaller flow cross section is oriented toward the coupler chamber and the section with the larger flow cross section is oriented toward the control chamber. The throttle suppresses or quickly damps the oscillations of the actuator in the transmission of the actuator stroke to the nozzle needle stroke.

A particularly useful embodiment for assuring a rapid stroke transmission provides that the first section is preceded by a third section on the side oriented toward the coupler chamber. Further, the second section is preceded by a fourth section on the side oriented toward the control chamber. These two sections have essentially the same flow cross section, which is greater than the larger flow cross section of the second section. It is advantageous if the conduit in the intermediate disk is situated off-center in relation to the central axis of the control chamber. A particularly effective damping and a rapid hydraulic transmission between the coupler chamber and control chamber is achieved if the ratio of the smaller flow cross section of the first section of the throttle to the cross-sectional area of the control chamber is between 0.05 and 0.1, preferably between 0.075 and 0.08. It is also preferable if the intermediate disk has at least one connecting conduit that hydraulically connects the nozzle needle chamber to a high-pressure chamber connected to the high-pressure connection. The intermediate disk contains a plurality of connecting conduits situated in a circular arrangement around the central axis of the control chamber.

BRIEF DESCRIPTION OF THE DRAWINGS

An exemplary embodiment of the invention is shown in the drawings and will be explained in detail in the description below; in which.

DESCRIPTION OF THE PREFERRED EMBODLMENTS

Figure 1:
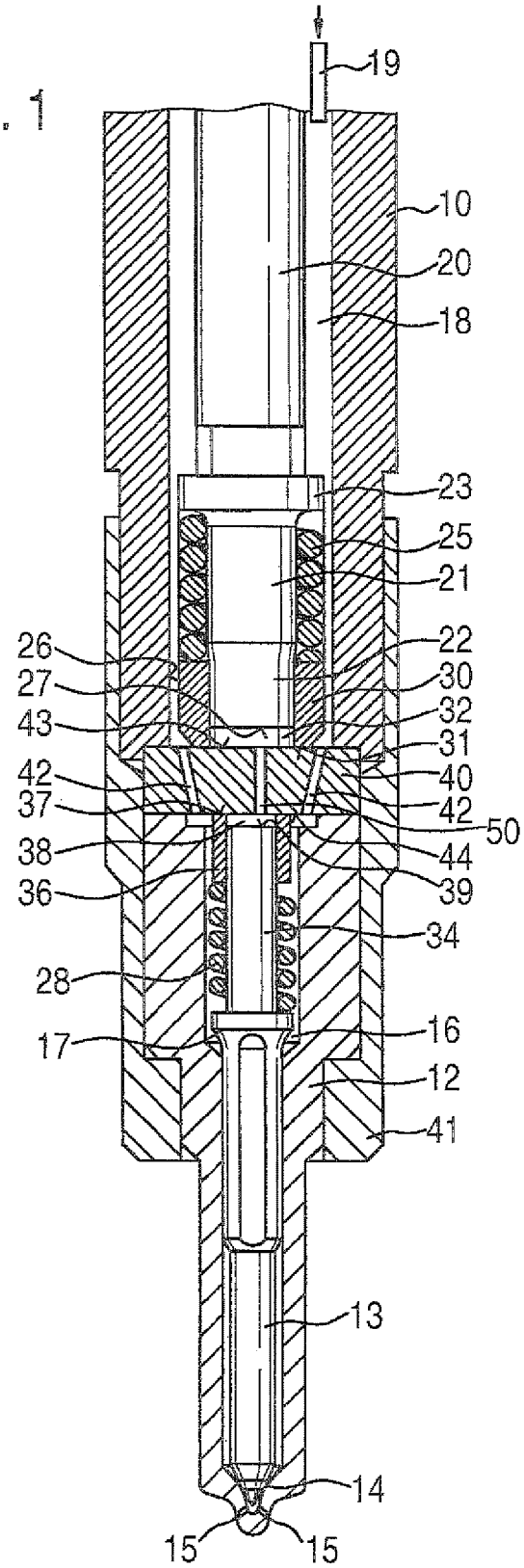
FIG. 1 is a sectional depiction of a part of a fuel injector according to the invention, at its end oriented toward the combustion chamber.

The fuel injector shown in FIG. 1 has an injector housing 10 that is equipped with an injection valve element and protrudes with a nozzle body 12 into a combustion chamber of an internal combustion engine. A nozzle needle 13 is guided in the nozzle body 12 in an axially movable fashion. In the nozzle body 12 at the tip of the nozzle needle 13, a nozzle needle sealing seat 14 is provided, downstream of which, with regard to the injection direction, are situated injection nozzles 15 that are situated in the nozzle body 12 and protrude into the combustion chamber. Upstream of the nozzle needle sealing seat 14, with regard to the injection direction, the injection valve element contains a nozzle needle pressure chamber 16 that acts on a pressure shoulder 17, which is provided on the nozzle needle 13 and is oriented toward the nozzle needle end.

The injector housing 10 has a pressure chamber 18 that is connected to a connection 19 of a high-pressure system, not shown, for example a common rail system of a diesel injection apparatus. A piezoelectric actuator 20 that is connected to an actuator-side coupler piston 21 is mounted in the high-pressure chamber 18. The actuator-side coupler piston 21 has a guide section 22 and an annular collar 23. A first sliding sleeve 30 is guided in axially movable fashion on the guide section 22 and is engaged by a compression spring 25 that rests against the collar 23 of the actuator-side coupler piston 21. So that the relatively long piezoelectric actuator 20, during its change in length, does not tilt the coupler piston 21 in the high-pressure chamber 18, the sliding sleeve 30 is additionally guided, for example, with guide surfaces, not shown, against a guide bore 26 in the axial direction inside the injector body 10.

Between the injector body 10 and the nozzle body 12, there is an intermediate throttle plate or disk 40, which is clamped in a hydraulically sealed fashion by means of a retaining nut 41. For example, the intermediate disk 40 has at least two connecting conduits 42 that hydraulically connect the high pressure chamber 18 to the nozzle needle pressure chamber 16. A sealing edge 31 of the first sliding sleeve 30 presses against an actuator-side end surface 43 embodied on the throttle plate 40. This forms a coupler chamber 32 inside the first sliding sleeve 30, to which a pressure surface 27 of the actuator-side coupler piston 21 is exposed.

The nozzle needle 13 has a nozzle-needle side coupler piston 34 situated on it and an additional sliding sleeve 36 is guided on this piston in an axially movable fashion. With an additional sealing edge 37, the additional sliding sleeve 36 presses against an end surface 44 of the intermediate plate 40 oriented toward the nozzle needle. The compressive force for the additional sealing edge 37 is exerted by means of an additional compression spring 28.

Inside the additional sliding sleeve 36, a control chamber 38 is formed, to which the pressure surface 39 of the nozzle-needle-side coupler piston 34 is exposed. In order to implement a stroke boosting of greater than one (>1) from the actuator-side coupler piston 21 to the nozzle-needle-side coupler piston 34, it is necessary for the diameter of the actuator-side coupler piston 21 or the pressure surface 27 to be greater than the diameter of the nozzle-needle-side coupler piston 34 or the additional pressure surface 39.

Figure 2:
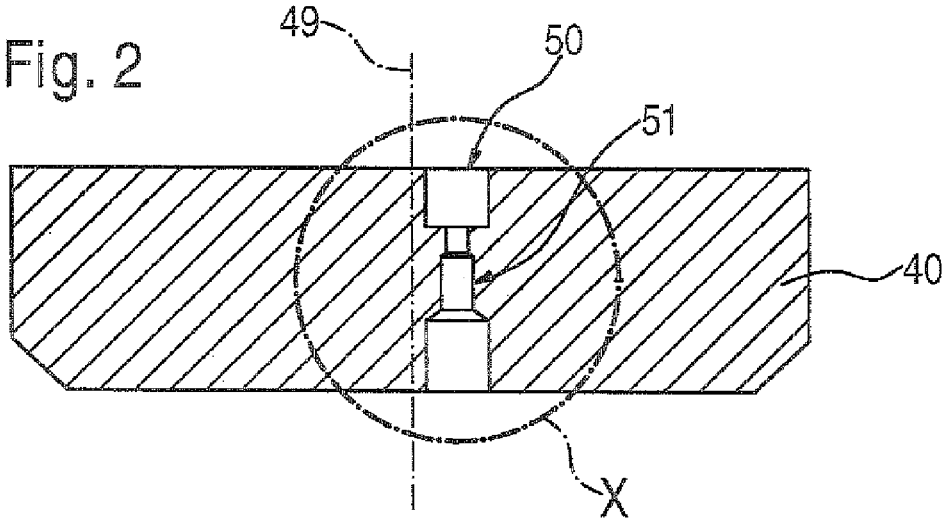
FIG. 2 is a sectional depiction of an intermediate plate.

A conduit 50 that hydraulically connects the coupler chamber 32 to the control chamber 38 passes through the throttle plate 40. The conduit 50, which is situated in the intermediate plate 40 and is arranged off-center in relation to the central axis 49 of the control chamber 38, has a hydraulic throttle 51 (FIG. 2).

Figure 3:
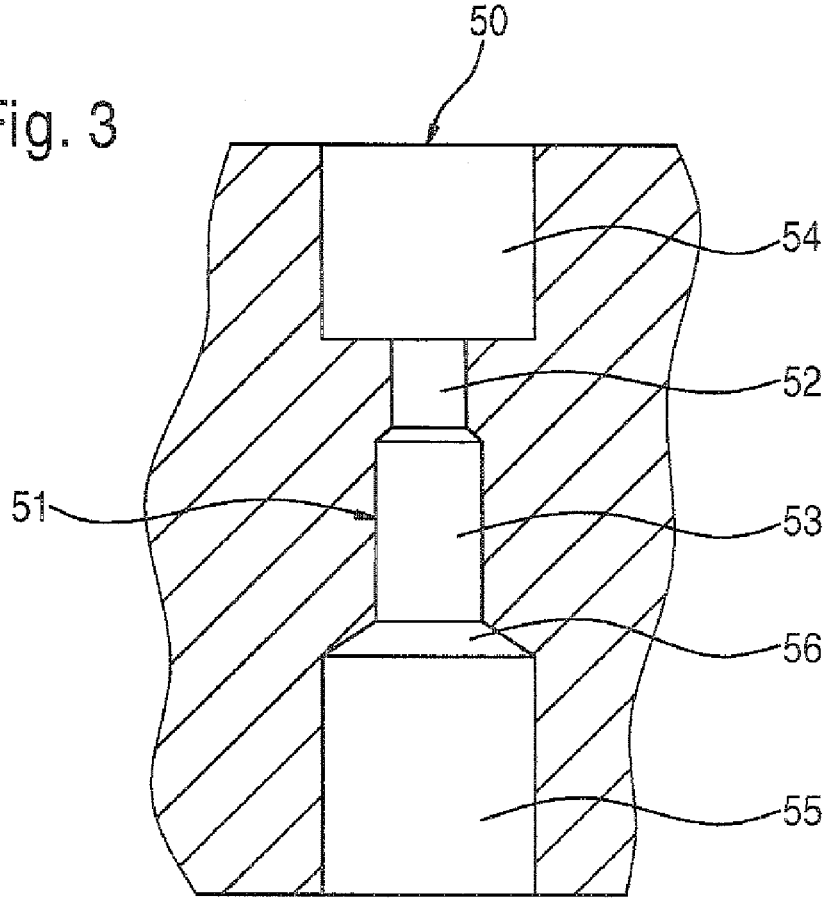
FIG. 3 is an enlarged detail X of the intermediate plate in FIG. 2.

The coupler chamber 32 and control chamber 38 function as boosting chambers in that the stroke of the actuator-side coupler piston 21 is boosted due to the larger pressure surface 27 in comparison to the smaller pressure surface 39 of the nozzle-needle-side coupler piston 34. The fuel used as a hydraulic medium for the boosting is transmitted via the conduit 50 with the throttle 51. In order to assure a both rapid and damping transmission of the fuel, according to FIG. 3, the throttle 51 has a first section 52 with a small flow cross section and a second section 53 with a larger flow cross section; the first section 52 with the small flow cross section is oriented toward the coupler chamber 32 and the second section 53 with the larger flow cross section is oriented toward the control chamber 38. In addition, the first section 52 is preceded by a third section 54 on the side oriented toward the coupler chamber 32 and the second section 53 is preceded by a fourth section 55 on the side oriented toward the control chamber 38. The sections 54 and 55 here have essentially the same flow cross section, which is in turn greater than the larger flow cross section of the second section 53. In addition, between the section 55 associated with the control chamber 38 and the second section 53 of the throttle 51, there is a conically extending transition 56 that tapers toward the second section 53.

Another decisive factor for an effective oscillation damping is the ratio of the diameter or cross-sectional area of the throttle 51 to the diameter or cross-sectional area of the control chamber 38. It has turned out that the oscillation of the nozzle needle 13 due to the boosting of the actuator stroke is effectively damped if the ratio of the area AD of the smaller flow cross section of the first section 52 of the throttle 51 to the cross-sectional area AK of the control chamber 38 is between 0.05 and 0.1, preferably from 0.075 to 0.08.

The injection with the fuel injector is initiated by means of a pulling piezoelectric actuator 20. To accomplish this, the piezoelectric actuator 20 is supplied with a voltage when the injection nozzles 15 are in the closed state. In order to initiate the injection, the voltage is reduced or switched to zero, causing the piezoelectric actuator 20 to contract and thus initiate a pulling stroke with the actuator-side coupler piston 21. In fuel injectors, this type of triggering is also referred to as inverse triggering of the piezoelectric actuator 20.

The pulling stroke executed by the actuator-side coupler piston 21 results in an expansion of the coupler chamber 32, which causes the pressure in the coupler chamber 32 to fall below the rail pressure or system pressure. The falling pressure in the coupler chamber 32 is transmitted via the conduit 50 equipped with the throttle 51 to the control chamber 38, causing the rail pressure acting on the pressure shoulder 17 in the nozzle needle pressure chamber 16 to be higher than the pressure acting on the pressure surface 39 in the control chamber 38. Because the pressure surface 39 is smaller than the pressure surface 27, the nozzle needle 13 is lifted away from the nozzle needle sealing seat 14 with a larger stroke than the stroke of the piezoelectric actuator 20. The lifting of the nozzle needle 13 away from the nozzle needle sealing seat 14 opens the injection nozzles 15 so that fuel is injected via the injection nozzles 15 at the rail pressure or system pressure prevailing in the nozzle needle pressure chamber 16.

In order to close the sealing seat 14, the piezoelectric actuator 20 is acted on with a voltage that causes a longitudinal expansion of the piezoelectric actuator 20, thus causing the actuator-side coupler piston 21 to push into the coupler chamber 32, raising the pressure therein. The pressure increase is transmitted to the control chamber 38 via the conduit 50 and the throttle 51 and acts on the additional pressure surface 39 of the nozzle-needle-side coupler piston 35. As a result, the nozzle needle 13 is returned to the nozzle needle sealing seat 14, assisted by the compression spring 28.

The foregoing relates to the preferred exemplary embodiment of the invention, it being understood that other variants and embodiments thereof are possible within the spirit and scope of the invention, the latter being defined by the appended claims.

The invention claimed is:

1. A fuel injector for an internal combustion engine, comprising:

an injection valve element having a nozzle needle guided in an axially movable fashion within a nozzle body;

a nozzle-needle-side coupler piston connected to the nozzle needle, which acts on a control chamber;

an actuator disposed in an injector housing;

an actuator-side coupler piston connected to the actuator, which acts on a coupler chamber either to relieve pressure in it or exert pressure on it; and an intermediate disk disposed between the injector housing and the nozzle body having a conduit which hydraulically connects the coupler chamber to the control chamber, the conduit containing a hydraulic throttle which has at least two sections with different flow cross sections, where a first section with a smaller flow cross section is oriented toward the coupler chamber and a second section with a larger flow cross section is oriented toward the control chamber, and wherein the first section is preceded by a third section within the throttle on the side oriented toward the coupler chamber and the second section is preceded by a fourth section within the throttle on the side oriented toward the control chamber, the third and fourth sections having essentially the same flow cross section, which is in turn greater than the larger flow cross section of the second section.

2. The fuel injector according to claim 1, wherein between the fourth section associated with the control chamber and the second section of the throttle, there is a conically extending transition that tapers toward the second section.

3. The fuel injector according to claim 2, wherein the intermediate disk contains a plurality of connecting conduits situated in a circular arrangement around a central axis of the control chamber.

4. The fuel injector according to claim 1, wherein the conduit in the intermediate disk is situated off-center in relation to a central axis of the control chamber.

5. The fuel injector according to claim 4, wherein the intermediate disk contains a plurality of connecting conduits situated in a circular arrangement around the central axis of the control chamber.

6. The fuel injector according to claim 1, wherein the smaller flow cross section of the first section has an area AD and the control chamber has a cross-sectional area AS and the ratio of the area AD to the cross-sectional area AS is between 0.05 and 0.1.

7. The fuel injector according to claim 6, wherein the intermediate disk contains a plurality of connecting conduits situated in a circular arrangement around a central axis of the control chamber.

8. The fuel injector according to claim 1, wherein the smaller flow cross section of the first section has an area AD and the control chamber has a cross-sectional area AS and the ratio of the area AD to the cross-sectional area AS is between 0.075 to 0.08.

9. The fuel injector according to claim 8, wherein the intermediate disk contains a plurality of connecting conduits situated in a circular arrangement around a central axis of the control chamber.

10. The fuel injector according to claim 1, wherein the intermediate disk has at least one connecting conduit that hydraulically connects a high-pressure chamber to a nozzle needle chamber.

11. The fuel injector according to claim 10, wherein the intermediate disk contains a plurality of connecting conduits situated in a circular arrangement around a central axis of the control chamber.

12. The fuel injector according to claim 1, wherein the intermediate disk contains a plurality of connecting conduits situated in a circular arrangement around a central axis of the control chamber.

13. The fuel injector according to claim 1, wherein a sliding sleeve is guided in axially movable fashion on a guide section of the actuator-side coupler piston.

14. The fuel injector according to claim 13, wherein the coupler chamber is formed by the sliding sleeve pressing against an actuator-side end surface embodied on the intermediate disk.

15. The fuel injector according to claim 14, wherein the sliding sleeve is pressed against the actuator-side end surface embodied on the intermediate disk by a compression spring that rests against a collar of the actuator-side coupler piston.

16. The fuel injector according to claim 1, wherein a sliding sleeve is guided in axially movable fashion on the nozzle-needle-side coupler piston.

17. The fuel injector according to claim 16, wherein the control chamber is formed by the sliding sleeve pressing against an end surface of the intermediate disk oriented toward the nozzle needle.

18. The fuel injector according to claim 17, wherein the sliding sleeve is pressed against an end surface of the intermediate disk oriented toward the nozzle needle by a compression spring situated between the sliding sleeve and the nozzle needle.

19. The fuel injector according to claim 1, wherein a first sliding sleeve is guided in axially movable fashion on a guide section of the actuator-side coupler piston and an additional sliding sleeve is guided in axially movable fashion on the nozzle-needle-side coupler piston, wherein the coupler chamber is formed by the first sliding sleeve pressing against an actuator-side end surface embodied on the intermediate disk and the control chamber is formed by the additional sliding sleeve pressing against an end surface of the intermediate disk oriented toward the nozzle needle.

20. The fuel injector according to claim 1, wherein the actuator-side coupler piston has a pressure surface and the nozzle-needle-side coupler piston has a pressure surface, wherein the pressure surface of the actuator-side coupler piston is greater than the pressure surface of the nozzle-needle-side coupler.

* * * * *